United States Patent [19]

Jahoda

[11] 4,197,625

[45] Apr. 15, 1980

[54] PLATE FIN COIL ASSEMBLY

[75] Inventor: John Jahoda, McMinnville, Tenn.

[73] Assignee: Carrier Corporation, Syracuse, N.Y.

[21] Appl. No.: 878,059

[22] Filed: Feb. 15, 1978

[51] Int. Cl.[2] ..... B23P 15/26

[52] U.S. Cl. ..... 29/157.3 V; 29/157.3 B; 113/118 B

[58] Field of Search ..... 29/157.3 A, 157.3 B, 29/157.3 C, 157.3 V; 165/151, 152, 182; 113/118 A, 118 B, 118 C, 118 V

[56] References Cited

U.S. PATENT DOCUMENTS

| | | | |
|---|---|---|---|
| 1,921,041 | 8/1933 | Reynolds | 29/157.3 B |
| 2,298,895 | 10/1942 | McKibben et al. | 29/157.3 B |
| 2,977,918 | 4/1961 | Kritzer | 113/118 |
| 2,994,123 | 8/1961 | Kritzer | 29/157.3 |
| 2,999,306 | 9/1961 | Baxter | 113/118 V |

*Primary Examiner*—Francis S. Husar
*Assistant Examiner*—V. K. Rising
*Attorney, Agent, or Firm*—J. Raymond Curtin; Robert P. Hayter

[57] ABSTRACT

A method of assembling a plate fin coil by making sheets of single pass single row plate fins from plate fin stock. The fins within each sheet are connected by tabular portions and have openings for the receipt of hairpin tubes which form part of the flow circuitry of the heat exchanger. A plurality of sheets are arranged in registration so that hairpin tubes may be inserted through the openings within the fins to form partially assembled heat exchanger coil cores. The adjacent coil cores may be separated at this point by rupturing the tabular portions connecting the fins within the various sheets or additional process steps may be completed simultaneously upon the entire coil bundle having many coil cores. At some time in the plate fin coil assembly process the rows of plate fins are separated into single or multi-row coils by rupturing the tabular portions to form the appropriate row size coil core. A coil bundle formed by partially assembling coil cores having sheets of connected fins is also disclosed.

6 Claims, 6 Drawing Figures

PLATE FIN COIL ASSEMBLY

BACKGROUND OF THE INVENTION

1. Field of the Invention

The present invention relates to the assembly of heat exchanger coils which are adapted to transfer heat between a fluid flowing through a tubular member within the coil and a fluid in contact with the fins of the coil. More specifically, the present invention relates to an apparatus and a method for assembling a plate fin coil adapted to be utilized as a condenser or evaporator of a refrigeration or air conditioning unit.

2. Description of the Prior Art

Plate fin coils utilized in the air conditioning and refrigeration industry are normally manufactured by first stamping or slitting from a coil of plate fin stock the appropriate size fins. The fins are then collected in the appropriate orientation and number to form a coil. Previously formed hairpin tubes are then inserted through the openings within the fins and thereafter expanded forming a mechanical and thermodynamic connection between the tubes and the fins. Thereafter, the partially assembled coil core is degreased, the return bends inserted into the hairpins and subsequently the return bends are soldered or brazed in place. The heat exchanger is then forwarded to storage or to an assembly line for immediate installation within the air conditioning or refrigeration system or unit.

The making of fins is typically accomplished in either a fin press or a fin slitting device to form both the exterior fin shape as well as surface variations on the fin and openings through which the tubular members may be inserted.

Generally, the air conditioning and refrigeration industry presently forms a plurality of single row fins of one or more passes simultaneously from a section of coiled plate fin stock. These individual fins are then collected on stacking rods or within a box or some other means is utilized to form a pile or stack of single row fins ready to be laced with a hairpin tube. This collection of individual rows of fins requires that each row be handled separately, laced separately and otherwise treated separately throughout the manufacturing process.

It is disclosed in U.S. Pat. Nos. 2,977,918 entitled, "Method of Making Heat Transfer Units", and 2,994,123 entitled, "Method of Forming Heat Transfer Units", that a series of plate fins could be manufactured having tabs or tabular portions connecting the adjacent plate fins such that the rows of fins could be separated from each other. These patents disclose bending the plate fin ribbon accordion style such that a sufficient length is utilized to form a fin pack for the coil core. Thereafter the rows of fins are separated from each other prior to any hairpin tube or other tubular member being inserted within the openings of the fins or prior to any other maufacturing process being accomplished on the fin pack. These patents further disclose that multi-row coils may be formed from the continuous fin pack by separating a plurality of rows from the remaining fin pack. However, there is no teaching of lacing the fin pack with hairpin tubes or proceeding with any other process manufacturing steps prior to the separation of the adjacent rows of fins.

The present invention is a plate fin coil utilizing single row fins such that a plurality of fins are stacked to from the fin pack rather than a single row being formed by a fin being bent upon itself numerous times to form the necessary passes for the fin pack. The present invention is further drawn to the fin pack being laced and other process steps being completed prior to the adjacent rows of fins being separated.

SUMMARY OF THE INVENTION

An object of the present invention is to provide a method of manufacture of plate fin coil.

A more specific object of the present invention is to manufacture sheets of attached plate fins such that multiple coil cores can be simultaneously processed through plate fin coil assembly.

A still more specific object of the present invention is to provide a coil bundle having multiple partially assembled coil cores such that the bundle may be stored or sent to the assembly line where individual coil cores may later be separated from the bundle by rupturing the tabular portions connecting adjacent rows of fins.

Another object of the present invention is to provide a method of assembling a heat transfer coil in which rows of fins are not collected singly but in groups and consequently laced in groups.

Other objects will be apparent from the description to follow and from the appended claims.

The preceding objects are achieved according to a preferred embodiment of the invention by the provision of sheets of fin stock, each sheet having a plurality of fins connected by rupturable tabular portions. The individual fins each have openings therein for the receipt of tubular members. A plurality of sheets are stacked in registration such that tubular members may be inserted into the openings of the fins to form partially assembled coil cores. Thereafter tube sheets may be added, the tubular members expanded into the fin pack, the whole assembly degreased, return bends inserted, return bends soldered to the tubular members and then the assembled coil bundle sent to storage or to an assembly line. Any time after lacing the fin pack with the tubular members being inserted into the openings of the fins the partially assembled coil cores may be separated from the remaining coil cores by rupturing the tabular portions between adjacent rows of fins. Dependent upon the particular production process being used it may be desirable to separate the partially assembled coil cores between several of the various manufacturing steps. It might also be advantageous to completely assemble the plate fin coils without detaching adjacent coils for storage or handling purposes.

DESCRIPTION OF THE PREFERRED EMBODIMENT

Figure 6:
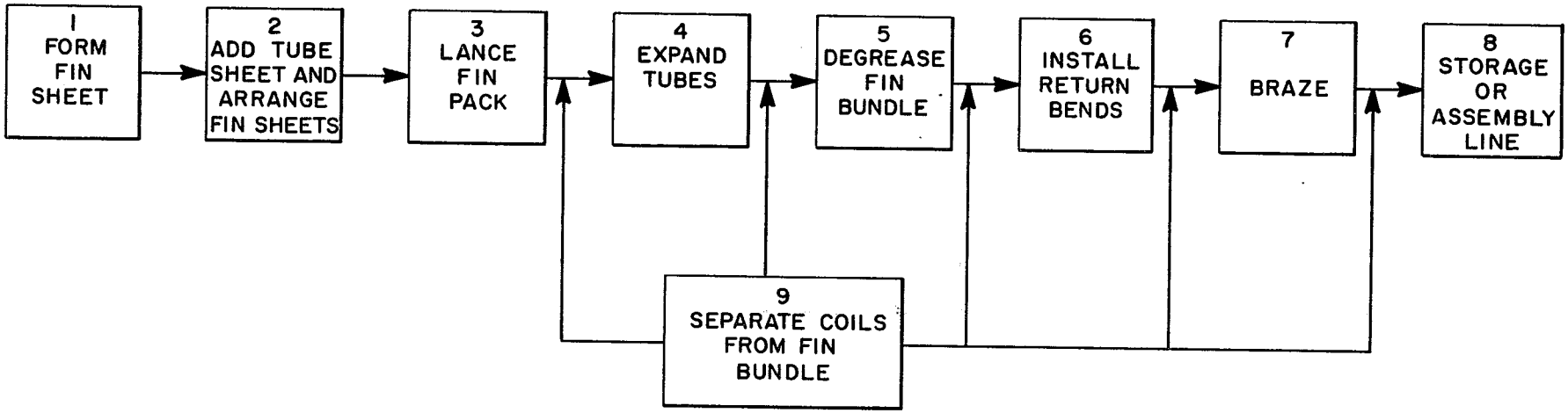
FIG. 6 is a schematic diagram pointing out some of the various process steps used in manufacturing plate fin coil to indicate that the rows of fins forming a partially assembled coil core may be separated from the coil bundle between many of the various production steps.

The embodiment of the invention described below is adapted for use in the manufacture of plate fin heat exchangers for use in air conditioning and refrigeration equipment. It is to be understood that the invention applies likewise to other heat exchangers and to other end uses of similar plate fin heat exchangers. Referring now to FIG. 6, a schematic diagram of a general outline of the steps involved in the manufacture of plate fin heat exchangers, it can be seen that the fin sheet is formed first then the tube sheet is added in registration with the fin sheets to form a fin pack. As denoted in block 3 this fin pack or fin bundle then has tubular members inserted through the openings in the various fins to form fluid flow paths for the various refrigerant circuits within the heat exchanger. This step is conventionally referred to as lacing the fin bundle with hairpin tubes. The next step denoted in block 4 is to expand the tubes either by running bullets (mechanical expansion elements) through the length of the tubes, hydraulically or otherwise to form a mechanical and thermodynamic bond between the tubes and the fins. The entire fin bundle is then degreased to remove lubricant remaining on the fin bundle from the steps of expanding the tubes and bending the tubes to form the hairpin tubes (not shown on the diagram). After the fin bundle is degreased, return bends are installed to complete the circuits of fluid flow within the heat exchanger. Step 7 is then to braze, solder, or otherwise join the return bends to the hairpins to form a fluid tight flow circuit. Thereafter the entire bundle may be sent to storage for future use or to an assembly line for immediate installation within the end product. Step 9 as designated on the diagram indicates that the individual or multiple rows forming the coil cores may be separated from the fin bundle at any time after the fin bundle has been laced depending upon the nature and size of the fin bundle, the nature and size of the individual coil desired, and the various process steps involved. It may be advantageous to separate the coil cores at any time after the step denoted in block 3 through the step denoted in block 8.

Figure 1:
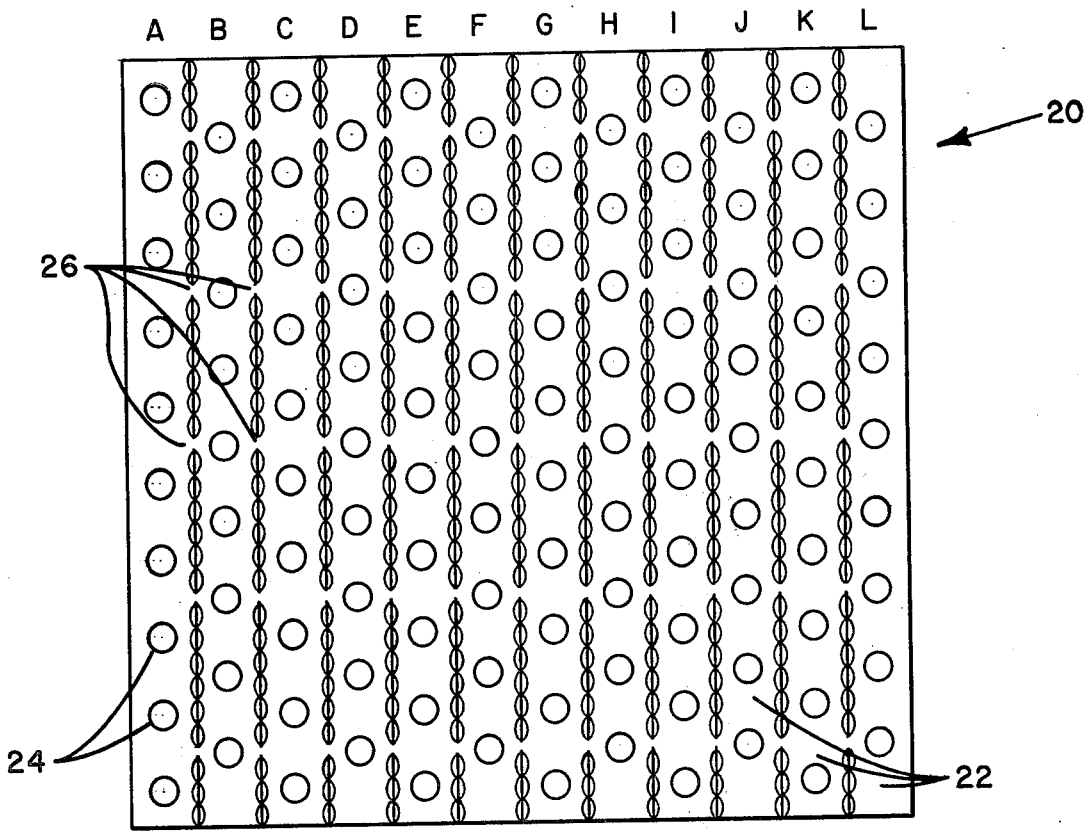
FIG. 1 is a top view of a fin sheet showing the individual fins and the tabular portions connecting them to each other.

Referring now to the drawings, it can be seen in FIG. 1 that coil plate fin stock having the appropriate width to form twelve rows of plate fins could be stamped or slit to form a sheet 20 as shown. Sheet 20 is comprised of fins 22 denoted individually as A, B, C through L, each fin having openings 24 for the receipt of tubular members. The fins of sheet 20 are connected to each other by tabular portions 26. These tabular portions are spaced along the intersection between adjacent fins and are of sufficient strength to secure the fins to each other and of sufficient weakness to allow the fins to be separated upon the application of a force.

Figure 2:
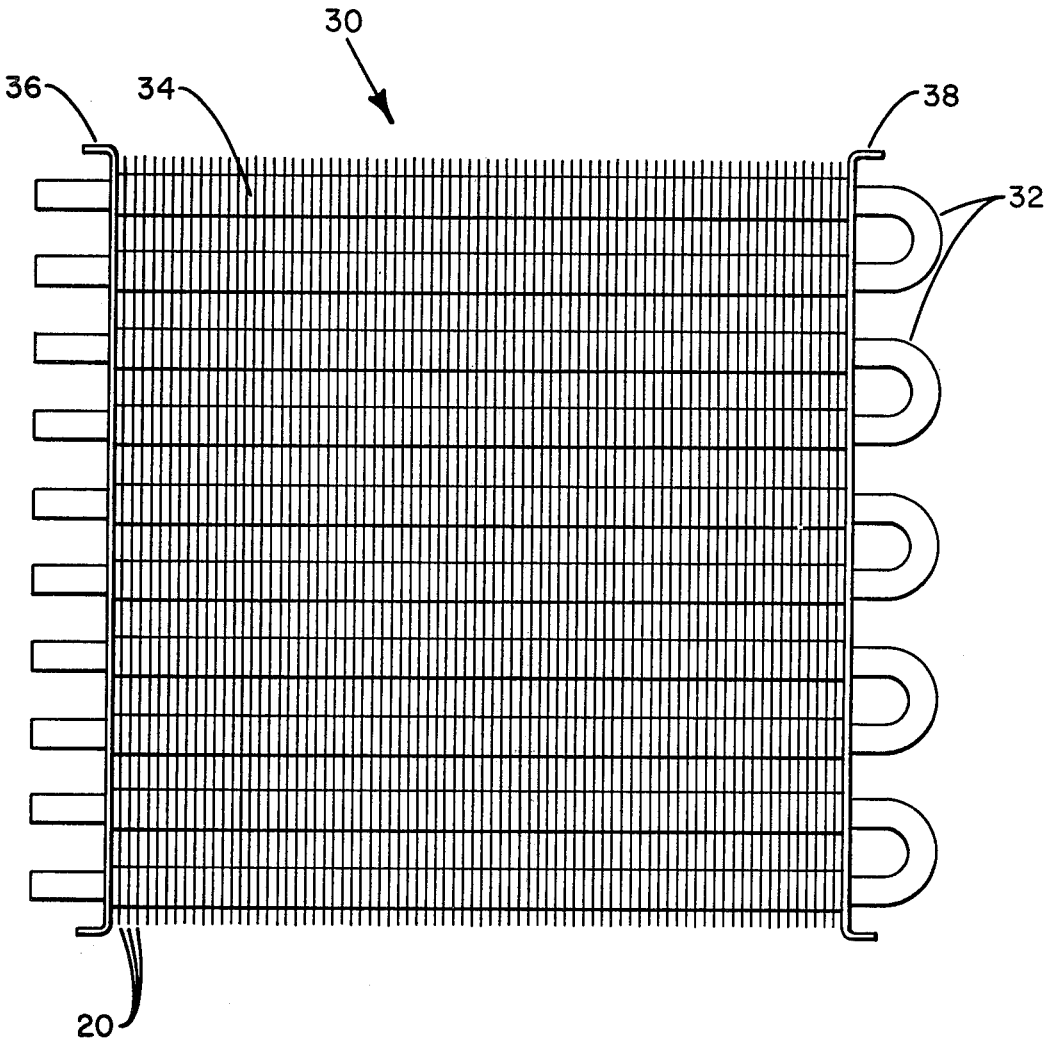
FIG. 2 is a side view of a plate fin coil bundle formed from a plurality of plate fins, tube sheets and hairpins.
Figure 3:
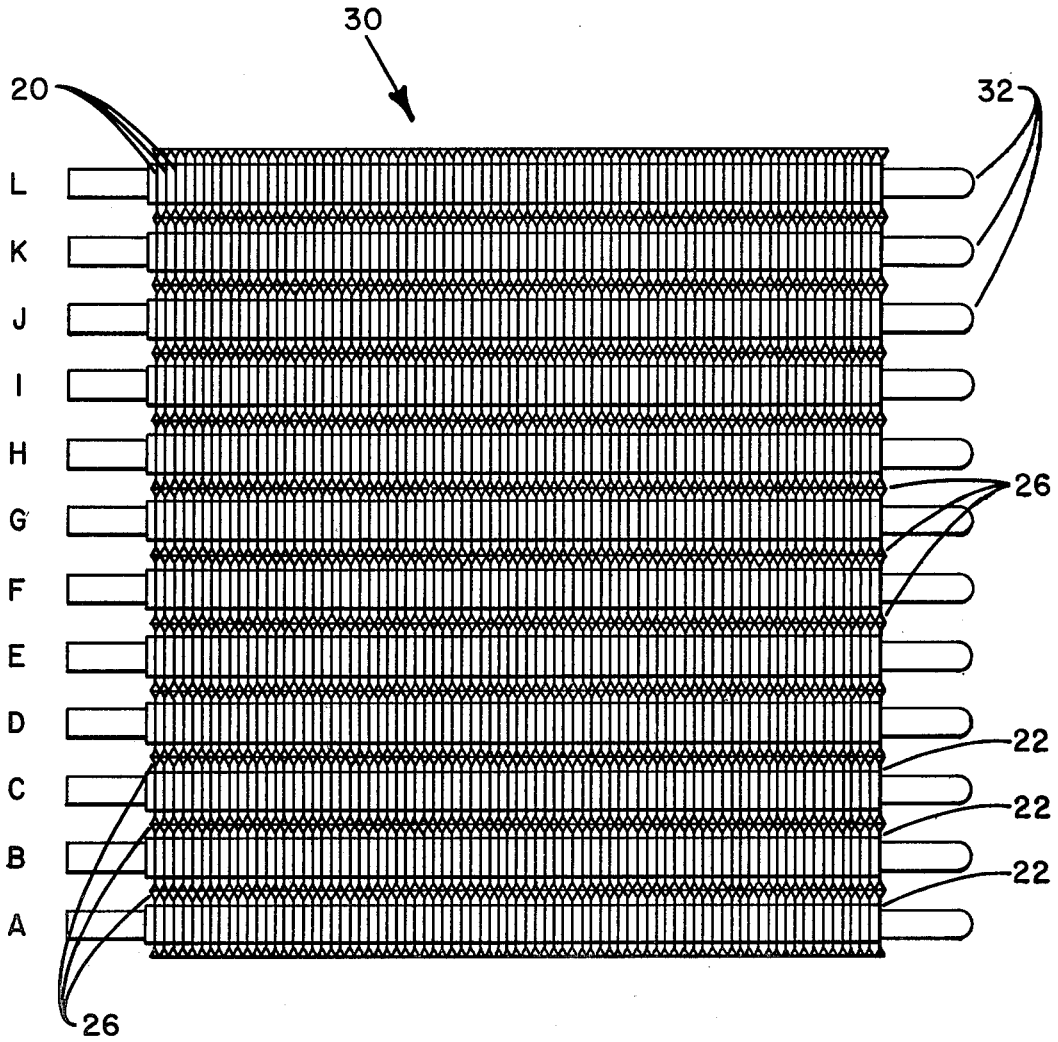
FIG. 3 is a top view of a plate fin coil bundle showing the hairpins within the openings of the fins and the location of the rupturable tabular portions in reference thereto.

It can be seen in FIG. 2 that once a series of sheets 20 are arranged in registration and tube sheets 36 and 38 are placed at the ends thereof that hairpins 32 may be inserted through the tube sheets and through the openings 24 of the fins which make up the fin sheets. This entire assembly designated as coil bundle 30 is then ready for further manufacturing steps. Hairpins 32 are shown as having tubular legs 34 such that the tubular legs are relatively straight from tube sheet 36 through tube sheet 38 and relatively straight through the numerous fins between the individual tube sheets. FIG. 3, a top view of the plate fin coil bundle, shows hairpins 32 inserted within the openings of the fins. Sheets 20 of fins are shown with tabular portions 26 separating adjacent rows of fins, each row having a hairpin 32 and being that area between adjacent tabular portions 26. Fins 22, one from each sheet 20, are so arranged as to form a single row of fins upon each hairpin tube.

Figure 4:
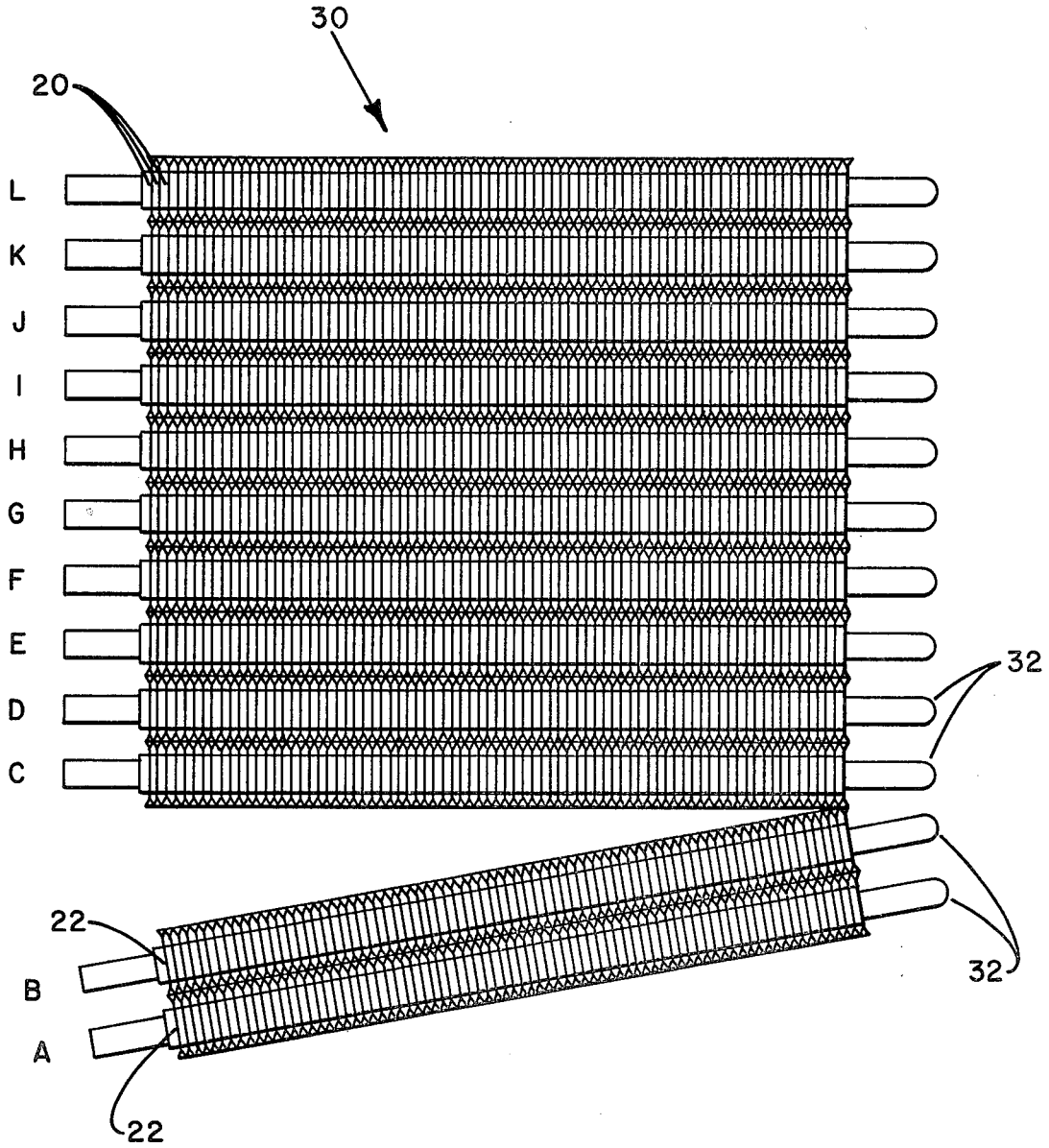
FIG. 4 is a top view of plate fin coil bundle showing a two row coil being removed from the fin bundle by rupturing the connecting tabular portions.

Referring now to FIG. 4 which is the same view as FIG. 3 only having coil rows A and B formed of fins A and B of the various sheets 20 being separated from fin bundle 30. As shown in FIG. 3, it is apparent that the tabular portion 26 joining fin B to fin C of the various fin sheets 20 have been ruptured so that a two row coil core is separated from the fin bundle.

Figure 5:
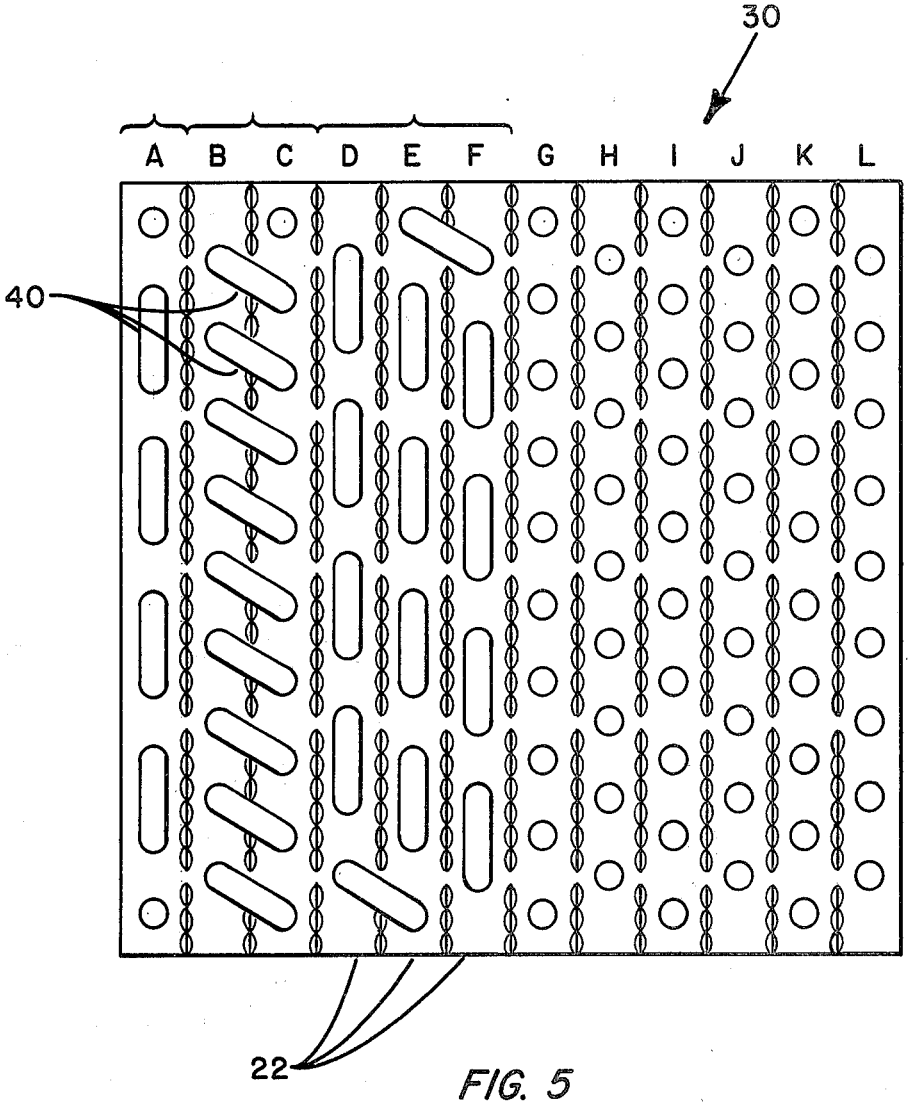
FIG. 5 is an end view of a plate fin coil bundle with connections shown for a single row coil, a double row coil and a triple row coil.

Once the hairpin tubes are assembled through coil bundle 30 then additional process steps may be taken prior to the separation of the individual coil cores from the coil bundle. The steps include installing return bends to the hairpins to form refrigerant flow circuits throughout the heat exchanger. The choice of refrigerant flow path and circuiting is dependent upon the type of coil being utilized and the number of rows of the coil. In FIG. 5 for the purpose of illustration, a single row coil consisting of fins A of the fin sheets is shown wherein adjacent hairpins are merely connected by return bends 40 to each other. A double row coil formed from fins B and C of the various fin sheets is shown having return bends 40 interconnecting hairpins from rows B and C as well as within rows B and C. It can also be seen in FIG. 5, that a triple row coil is provided utilizing fins D, E and F of the various fin sheets therein. Merely for illustration purposes return bends are shown connecting tubular members of different coil rows to form the selected coil cores. Of course, the selection of return bends and even the number of fluid circuits through the coil core is dependent upon the application desired. The number of return bends or other tubes joining the various tubular members are such that the operator may install them at his discretion depending upon the particular design, and refrigerant route desired within the coil.

From the above description it is apparent that a method of manufacture of a plate fin heat transfer coil has been disclosed which saves manual handling time of stacks of fins, of partially assembled coil cores and of other components of a plate fin coil. It may also be obvious that utilization of these methods will save time, money, energy and result in a more efficient process to assemble heat exchangers.

The invention has been described in detail with particular reference to a preferred embodiment thereof, but it will be understood that variations or modifications can be effected within the spirit and scope of the invention.

I claim:

1. A method of assembling a plate fin coil which comprises the steps of:

forming sheets of single pass plate fins from plate fin stock, said plate fins having openings for the receipt of tubular members and the individual plate fins of said sheet being secured by tabular portions of plate fin stock to the adjacent fins, said tabular portions being sized to rupture upon the application of a force such that the fins connected by the tabular portions may be separated;

arranging a plurality of sheets of single pass plate fins such that the openings therein are in registration;

lacing the sheets of plate fin by inserting tubes through the plate fin openings such that the sheets of fins are spaced along the tubes; and separating the now partially assembled coil cores by rupturing at least some of the tabular portions connecting adjacent fins resulting in a plurality of partially assembled coils having the appropriate fin arrangement.

2. The invention as set forth in claim 1 and further including prior to the step of separating the step of:

expanding the tubes within the sheets of fins to enhance the thermal transfer between the tubes and the fins.

3. The invention as set forth in claim 2 and further including the step of:

degreasing the partial assembly of sheets, fin stock and tubes.

4. The invention as set forth in claim 3 and further including prior to the step of separating the steps of:

affixing return bends to the tubes to connect the tubes to form at least one fluid circuit through the coil cores; and soldering the return bends to the tubes to form a fluid tight coil.

5. The invention as set forth in claim 1 wherein the step of lacing includes arranging the tubes inserted through the plate fin openings such that multiple row coils are assembled through the openings in multiple fins and thereafter when the partially assembled coils are separated the tabular portions connecting adjacent fins are ruptured only between the partially assembled multiple row coils and the adjacent partially assembled coil.

6. A method of manufacturing a plate fin heat exchanger which comprises the steps of:

forming sheets of single pass single row plate fins from coiled plate fin stock, said fins having spaced openings sized to receive the tubular legs of a hairpin tube and the individual plate fins of the sheet being secured by tabular portions of plate fin stock to the adjacent fins, said tabular portions being sized to rupture upon the application of a force such that the fins connected by the tabular portions are separated;

arranging a plurality of sheets of fins such that the openings therein are in registration and rows of fins are provided;

lacing the sheets of plate fin by inserting the tubular legs of hairpin tubes through the openings in the various rows of fins; and separating rows of fins from the remaining rows of fins by rupturing the tabular portions connecting adjacent fins between hairpin tubes to form the appropriate row heat exchanger.

* * * * *